US006330013B1

(12) United States Patent
Kashiwaya et al.

(10) Patent No.: US 6,330,013 B1
(45) **Date of Patent: *Dec. 11, 2001**

(54) THERMAL HEAD AND METHOD OF MANUFACTURING THE SAME

(75) Inventors: Makoto Kashiwaya, Kanagawa; Junichi Yoneda; Taihei Noshita, both of Shizuoka, all of (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/020,345

(22) Filed: Feb. 9, 1998

(30) Foreign Application Priority Data

Feb. 7, 1997 (JP) ..... 9-025278

(51) Int. Cl.[7] ..... B41J 2/335
(52) U.S. Cl. ..... 347/203
(58) Field of Search ..... 347/200, 203; 428/908.8

(56) References Cited

U.S. PATENT DOCUMENTS 5,238,705 * 8/1993 Hayashi et al. ..... 347/203
5,368,937 * 11/1994 Itoh ..... 347/203
5,557,313 * 9/1996 Nakayama et al. ..... 347/203

FOREIGN PATENT DOCUMENTS 61-53955 11/1986 (JP) ..... B41J/3/20
2-211958 * 4/1990 (JP) ..... 347/203
2-137944 * 5/1990 (JP) ..... 347/203
3-093554 * 4/1991 (JP) ..... 347/203
4-62866 10/1992 (JP) ..... B41J/2/335
7-102377 4/1995 (JP) .
7-132628 * 5/1995 (JP) ..... B41J/2/335

* cited by examiner

*Primary Examiner*—Huan Tran
(74) *Attorney, Agent, or Firm*—Sughrue, Mion, Zinn, Macpeak & Seas, PLLC

(57) ABSTRACT

The invention provides an improved thermal head having a protective film of a heater which comprises a carbon-based protective layer having a hardness difference in its thickness direction. The invention also provides an improved method of manufacturing the thermal head. A thermal head is thus obtained having a protective layer which is significantly protected from corrosion and wear, also from cracks and peeling-off due to heat and mechanical impact, and which allows the thermal head to have a sufficient durability to exhibit a high reliability over an extended period of time, thereby ensuring that the thermal recording of high-quality images is performed consistently over an extended period of operation.

12 Claims, 4 Drawing Sheets

THERMAL HEAD AND METHOD OF MANUFACTURING THE SAME

BACKGROUND OF THE INVENTION

This invention relates to the art of thermal heads for thermal recording which are used in various types of printers, plotters, facsimile, recorders and the like as recording means.

Thermal materials comprising a thermal recording layer on a substrate of a film or the like are commonly used to record images produced in diagnosis by ultrasonic scanning.

This recording method, also referred to as thermal recording, eliminates the need for wet processing and offers several advantages including convenience in handling. Hence in recent years, the use of the thermal recording system is not limited to small-scale applications such as diagnosis by ultrasonic scanning and an extension to those areas of medical diagnoses such as CT, MRI and X-ray photography where large and high-quality images are required is under review.

As is well known, thermal recording involves the use of a thermal head having a heater (glaze), in which heating elements comprising heat-generating resistors and electrodes, used for heating the thermal recording layer of a thermal material to record an image are arranged in one direction (main scanning direction) and, with the glaze urged at small pressure against the thermal material (thermal recording layer), the two members are moved relative to each other in the auxiliary scanning direction perpendicular to the main scanning direction, and the heating elements of the respective pixels on the glaze are heated by energy application in accordance with image data to be recorded which were supplied from an image data supply source such as MRI and CT in order to heat the thermal recording layer of the thermal material and form color, thereby accomplishing image reproduction.

A protective film is formed on the surface of the glaze of the thermal head in order to protect the heat-generating resistors for heating thermal materials, the associated electrodes and the like. It is this protective film that contacts the thermal material during thermal recording and the heat-generating resistors heat the thermal material through this protective film so as to perform thermal recording.

The protective film is usually made of wear-resistant ceramics; however, during thermal recording, the surface of the protective film is heated and kept in sliding contact with the thermal material, so it will gradually wear and deteriorate upon repeated recording.

If the wear of the protective film progresses, density ununiformity will occur on the thermal image or a desired protective strength can not be maintained and, hence, the ability of the film to protect the resistors is impaired to such an extent that the intended image recording is no longer possible (the head has lost its function).

Particularly in the application such as the aforementioned medical use which require multiple gradation images of high quality, the trend is toward ensuring the desired high image quality by adopting thermal films with highly rigid substrates such as polyester films and also increasing the setting values of recording temperature (energy applied) and of the pressure at which the thermal head is urged against the thermal material. Under these circumstances, as compared with the conventional thermal recording, a greater force and more heat are exerted on the protective film of the thermal head, making wear and corrosion (or wear due to corrosion) more likely to progress.

With a view to preventing the wear of the protective film on the thermal head so as to improve its durability, a number of techniques have been considered in order to improve the performance of the protective film. Among others, a carbon-based protective film (hereinafter referred to as a carbon protective layer) is known as a protective film excellent in resistance to wear and corrosion.

Thus, Examined Published Japanese Patent Applications (KOKOKU) No. 61-53955 and No. 4-62866 (the latter being the divisional application of the former) disclose a thermal head excellent in wear resistance and response obtained by forming a very thin carbon protective layer having a Vickers hardness of 4500 kg/mm$^2$ or more as the protective film of the thermal head and a method of manufacturing the thermal head, respectively.

Moreover, Unexamined Published Japanese Patent Application (KOKAI) No. 7-132628 discloses a thermal head which has a dual protective film comprising a lower silicon-based compound layer and an overlying diamond-like carbon layer, whereby the potential wear and breakage of the protective film are significantly reduced to ensure that high-quality image can be recorded over an extended period of time.

These carbon protective layers have properties quite similar to those of diamond including a very high hardness and chemical stability, hence excellent properties to prevent wear and corrosion which may be caused by the sliding contact with thermal materials.

The carbon protective layers are however brittle because of their hardness, that is, low in tenacity, although they are excellent in wear resistance. Heat shock and a thermal stress due to heating of heating elements, a stress due to a difference in coefficient of thermal expansion between the carbon protective layer and the layer adjacent thereto, a mechanical impact due to a foreign matter entered between the thermal material and the thermal head (glaze) during recording or other factors may bring about relatively easily cracks or peeling-off.

The cracks or peeling-off in the protective layer give rise to wear, corrosion and wear due to corrosion, which results in reduction of the durability of the thermal head. The thermal head is not capable of exhibiting a high reliability over an extended period of time.

SUMMARY OF THE INVENTION

The present invention has been accomplished under these circumstances and has as an object providing a thermal head having a carbon-based protective layer which is significantly protected from corrosion and wear, also from cracks and peeling-off due to heat and mechanical impact, and which allows the thermal head to have a sufficient durability to exhibit a high reliability over an extended period of time, thereby ensuring that the thermal recording of high-quality images is performed consistently over an extended period of operation.

Another object of the invention is to provide a method of manufacturing the thermal head.

To attain the above objects, the invention provides a thermal head having a protective film of a heater which comprises a carbon-based protective layer having a hardness difference in its thickness direction.

In another aspect of the invention, there is provided a thermal head in which a protective layer having a hardness difference in its thickness direction is formed on a surface of a heater by applying a radio-frequency bias voltage to the surface of the heater while changing the voltage value, in an atmosphere in which a carbon-based gas is ionized.

In a further aspect of the invention, there is provided a thermal head in which a protective layer having a hardness difference in its thickness direction is formed on a surface of a heater by producing a plasma on the surface of the heater in a hydrogen gas atmosphere while evaporating a carbon-based solid, applying a radio-frequency bias voltage and changing a flow rate of said hydrogen gas.

In the thermal head of the invention, it is preferred that said hardness difference is more than 100 kg/mm$^2$ in terms of Vickers hardness and that at least one ceramic-based protective layer is provided as a lower protective layer on the heater side of said carbon-based protective layer.

The invention also provides a method of manufacturing a thermal head comprising the steps of disposing in a chamber at least a part of the thermal head including a heater, introducing a carbon-based gas into said chamber for ionization and applying a radio-frequency bias voltage to the surface of the heater while changing the voltage value, whereby a protective layer having a hardness difference in its thickness direction is formed on the surface of the heater.

In another aspect of the invention, there is provided a method of manufacturing a thermal head comprising the steps of disposing in a chamber at least a part of the thermal head including a heater, evaporating a carbon-based solid in said chamber while introducing a hydrogen gas into said chamber to produce a plasma on the surface of the heater, applying a radio-frequency bias voltage and changing the flow rate of said hydrogen gas, whereby a protective layer having a hardness difference in its thickness direction is formed on the surface of the heater.

DETAILED DESCRIPTION OF THE INVENTION

The thermal head and the method of manufacturing the thermal head according to the invention will now be described in detail with reference to the preferred embodiments shown in the accompanying drawings.

Figure 1:
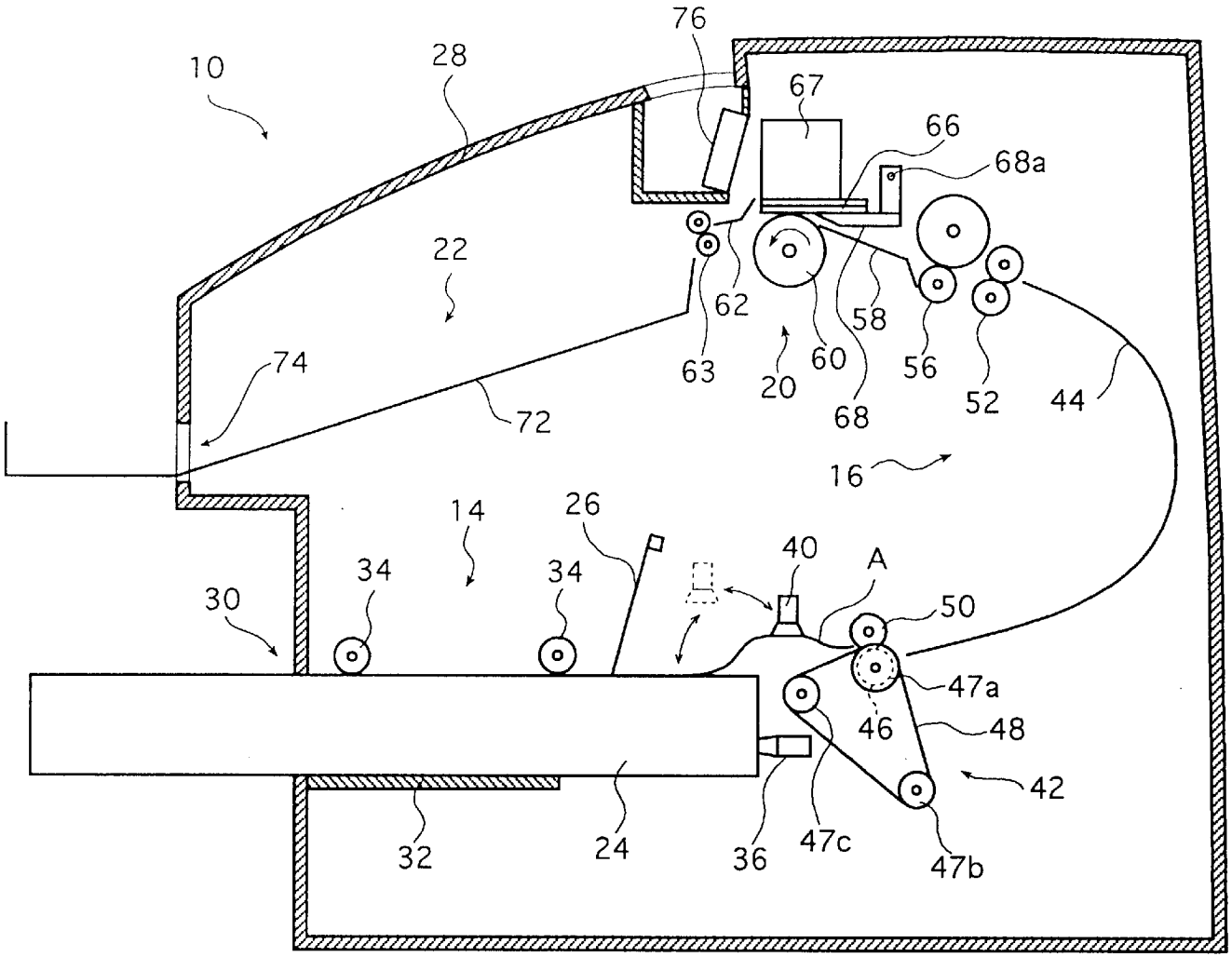
FIG. 1 shows the concept of an exemplary thermal recording apparatus using the thermal head of the invention.

FIG. 1 shows schematically an exemplary thermal recording apparatus using the thermal head of the invention.

The thermal recording apparatus generally indicated by 10 in FIG. 1 and which is hereinafter simply referred to as a "recording apparatus 10" performs thermal recording on thermal materials of a given size, say, B4 (namely, thermal materials in the form of cut sheets, which are hereinafter referred to as "thermal materials A"). The apparatus comprises a loading section 14 where a magazine 24 containing thermal materials A is loaded, a feed/transport section 16, a recording section 20 performing thermal recording on thermal materials A by means of a thermal head 66, and an ejecting section 22.

In the thus constructed recording apparatus 10, a thermal material A is taken out of the magazine 24 and transported to the recording section 20, where the thermal material A against which the thermal head 66 is pressed is transported in the auxiliary scanning direction perpendicular to the main scanning direction in which the heater (or the glaze) extends (normal to the papers of FIGS. 1 and 2) and in the meantime, the individual heating elements are actuated in accordance with image data on the image to be recorded to perform thermal recording on the thermal material A.

The thermal material A comprises a substrate of a resin film such as a transparent polyethylene terephthalate (PET) film, a paper or the like which are overlaid with a thermal recording layer.

Typically, such thermal materials A are stacked in a specified number, say, 100 to form a bundle, which is either wrapped in a bag or bound with a band to provide a package. As shown, the specified number of thermal materials A bundle together with the thermal recording layer side facing down are accommodated in the magazine 24 of the recording apparatus 10, and they are taken out of the magazine 24 one by one to be used for thermal recording.

The magazine 24 is a case having a cover 26 which can be freely opened. The magazine 24 which contains the thermal materials A is loaded in the loading section 14 of the recording apparatus 10.

The loading section 14 has an inlet 30 formed in the housing 28 of the recording apparatus 10, a guide plate 32, guide rolls 34 and a stop member 36; the magazine 24 is inserted into the recording apparatus 10 via the inlet 30 in such a way that the portion fitted with the cover 26 is coming first; thereafter, the magazine 24 as it is guided by the guide plate 32 and the guide rolls 34 is pushed until it contacts the stop member 36, whereupon it is loaded at a specified position in the recording apparatus 10.

The loading section 14 is equipped with a mechanism (not shown) for opening or closing the cover 26 of the magazine.

The feed/transport section 16 has the sheet feeding mechanism using a sucker 40 for grabbing the thermal material A by application of suction, transport means 42, a transport guide 44 and a regulating roller pair 52 located in the outlet of the transport guide 44; thermal materials A are taken one by one out of the magazine 24 in the loading section 14 and transported to the recording section 20.

The transport means 42 comprises a transport roller 46, a pulley 47*a* coaxial with the roller 46, a pulley 47*b* coupled to a rotating drive source, a tension pulley 47*c*, an endless belt 48 stretched between the three pulleys 47*a*, 47*b* and 47*c*, and a nip roller 50 that pairs with the transport roller 46. The forward end of the thermal material A which has been sheet-fed by means of the sucker 40 is pinched between the transport roller 46 and the nip roller 50 such that the material A is transported.

When a signal for the start of recording is issued, the cover 26 is opened by the OPEN/CLOSE mechanism in the recording apparatus 10. Then, the sheet feeding mechanism using the sucker 40 picks up one sheet of thermal material A from the magazine 24 and feeds the forward end of the sheet to the transport means 42 (to the nip between rollers 46 and 50). At the point of time when the thermal material A has been pinched between the transport roller 46 and the nip roller 50, the sucker 40 releases the material, and the thus fed thermal material A is supplied by the transport means 42 into the regulating roller pair 52 as it is guided by the transport guide 44.

At the point of time when the thermal material A to be used in recording has been completely ejected from the magazine 24, the OPEN/CLOSE mechanism closes the cover 26.

The distance between the transport means 42 and the regulating roller pair 52 which is defined by the transport guide 44 is set to be somewhat shorter than the length of the thermal material A in the direction of its transport. The forward end of the thermal material A first reaches the regulating roller pair 52 as the result of transport by the transport means 42. The regulating roller pair 52 are first at rest. The forward end of the thermal material A stops here and is subjected to positioning.

When the forward end of the thermal material A reaches the regulating roller pair 52, the temperature of the thermal head 66 (the glaze) is checked and if it is at a specified level, the regulating roller pair 52 starts to transport the thermal material A, which is transported to the recording section 20.

The recording section 20 has the thermal head 66, a platen roller 60, a cleaning roller pair 56, a guide 58, a heat sink 67 for cooling the thermal head 66, a cooling fan 76 and a guide 62.

The thermal head 66 is capable of thermal recording at a recording (pixel) density of, say, about 300 dpi up to, for example, 356×432 size. Except for the protective film, the head has a known structure in that it has the glaze in which the heating elements performing thermal recording on the thermal material A are arranged in one direction, that is in the main scanning direction, and the cooling heat sink 67 is fixed to the thermal head 66. The thermal head 66 is supported on a support member 68 that can pivot about a fulcrum 68*a* in the up and down direction.

The glaze of the thermal head 66 will be described in detail later.

It should be noted that the thermal head 66 of the invention is not particularly limited in such aspects as the width (in the main scanning direction), resolution (recording density) and recording contrast; preferably, the head width ranges from 5 cm to 50 cm, the resolution is at least 6 dots/mm (ca. 150 dpi), and the recording contrast consists of at least 256 levels.

Figure 2:
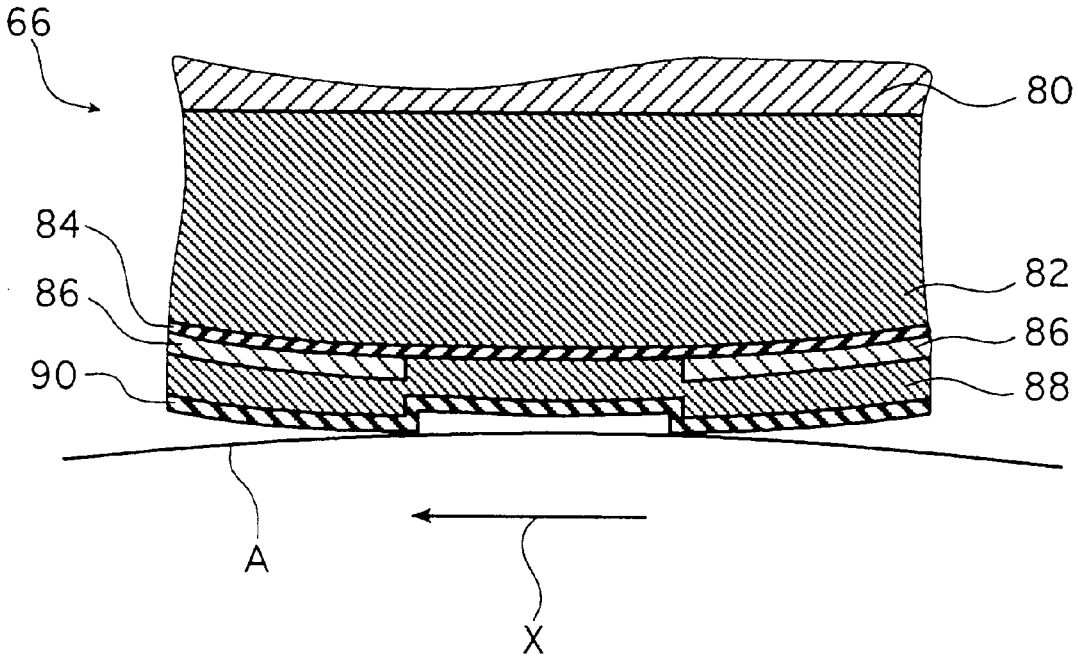
FIG. 2 is a schematic diagram showing the structure of a heating element in the thermal head of the invention.

The platen roller 60 rotates at a specified image recording speed while holding the thermal material A in a specified position in the direction shown by the arrow in FIG. 1, and transports the thermal material A in the auxiliary scanning direction perpendicular to the main scanning direction (the direction shown by the arrow X in FIG. 2).

The cleaning roller pair 56 comprises an adhesive rubber roller made of an elastic material (upper side in the drawing) and a non-adhesive roller. The adhesive rubber roller picks up dirt and other foreign matter that has been deposited on the thermal recording layer of the thermal material A, thereby preventing the dirt from being deposited on the glaze or otherwise adversely affecting the image recording operation.

Before the thermal material A is transported to the recording section 20, the support member 68 in the illustrated recording apparatus 10 has pivoted to UP position so that the glaze of the thermal head 66 is in the standby position just before coming into contact with the platen roller 60.

When the transport of the thermal material A by the regulating roller pair 52 starts, said material is subsequently pinched by the cleaning roller pair 56 and transported as it is guided by the guide 58. When the forward end of the thermal material A has reached the record START position (i.e., corresponding to the glaze), the support member 68 pivots to DOWN position and the thermal material A becomes pinched between the glaze and the platen roller 60 such that the glaze is pressed onto the recording layer while the thermal material A is transported in the auxiliary scanning direction by means of the platen roller 60 and other parts as it is held in a specified position by the platen roller 60.

During this transport, the respective heating elements on the glaze are actuated imagewise to perform thermal recording on the thermal material A.

After the end of thermal recording, the thermal material A as it is guided by the guide 62 is transported by the platen roller 60 and the transport roller pair 63 to be ejected into a tray 72 in the ejecting section 22. The tray 72 projects exterior to the recording apparatus 10 via the outlet 74 formed in the housing 28 and the thermal material A carrying the recorded image is ejected via the outlet 74 for takeout by the operator.

FIG. 2 is a schematic cross section of the glaze (heater) of the thermal head 66. As shown, to form the glaze, the top of a substrate 80 (which is shown to face down in FIG. 2 since the thermal head 66 is pressed downward against the thermal material A) is overlaid with a glaze layer (heat accumulating layer) 82 which, in turn, is overlaid with a heat-generating resistor 84 which, in turn, is overlaid with electrodes 86 which, in turn, is overlaid with a protective film which protects the heat-generating resistor 84 and optionally the electrodes 86 and other parts.

FIG. 2 illustrates a preferred embodiment in which the protective film is composed of two layers: a ceramic-based lower protective layer 88 superposed on the heat-generating resistor 84 and the electrodes 86 (or the heating element), and a carbon-based upper protective layer, that is, carbon protective layer 90 (diamond-like carbon (DLC) protective layer) which is formed on the lower protective layer 88. The latter characterizes the invention.

Except for the carbon protective layer 90, the thermal head 66 for use in the invention has essentially the same structure as known versions of thermal head. Therefore, the arrangement of other layers and the constituent materials of the respective layers are not limited to any particular way and various known versions may be employed. Specifically, the substrate 80 may be formed of various electrical insulating materials including heat-resistant glass and ceramics such as alumina, silica and magnesia; the glaze layer 82 may be formed of heat-resistant glass, heat resistant resins including polyimide resin and the like; the heat-generating resistor 84 may be formed of heat-generating resistors such as Nichrome (Ni—Cr), tantalum metal and tantalum nitride; and the electrodes 86 may be formed of electrically conductive materials such as aluminum and copper.

Heating elements are known to be available in two types, one being of a thin-film type which is formed by a "thin-film" process such as vacuum evaporation, chemical vapor deposition (CVD) or sputtering and a photoetching technique, and the other being of a thick-film type which is formed by "thick-film" process comprising the steps of printing (e.g., screen printing) and firing and an etching technique. The thermal head 66 for use in the invention may be formed by either method.

As described above, the illustrated thermal head 66 according to a preferred embodiment comprises a protective film composed of the two layers: the carbon protective layer 90 and the lower protective layer 88. The presence of the lower protective layer enables acquirement of more preferred results in various aspects including resistance to wear, resistance to corrosion and resistance to corrosion wear. A thermal head having a higher durability and a long service life can be thus realized.

The lower protective layer 88 to be formed on the thermal head 66 of the invention may be formed of any known materials as long as they have sufficient heat resistance, corrosion resistance and wear resistance to serve as the protective film of the thermal head. Preferably, the ceramic-based lower protective layer 88 is illustrated.

Specific materials include silicon nitride (SiN), silicon carbide (SiC), tantalum oxide ($Ta_2O_5$), aluminum oxide ($Al_2O_3$), SIALON (SiAlON), silicon oxide ($SiO_2$), aluminum nitride (AlN), boron nitride (BN), selenium oxide (SeO), titanium nitride (TiN), titanium carbide (TiC), titanium carbide nitride (TiCN), chromium nitride (CrN) and mixtures thereof. Among others, silicon nitride, silicon carbide, SIALON are advantageously utilized in various aspects such as easy film deposition, reasonability in manufacturing including manufacturing cost, balance between mechanical wear and chemical wear. Additives such as metals may be incorporated in small amounts into the lower protective layer to adjust physical properties.

Methods of forming the lower protective layer 88 are not limited to any particular way and known methods of forming ceramic films (layers) may be employed by applying the aforementioned thick-film and thin-film processes and the like.

The thickness of the lower protective layer 88 is not limited to any particular value but it ranges preferably from about 2 $\mu$m to about 50 $\mu$m, more preferably from about 4 $\mu$m to about 20 $\mu$m. If the thickness of the lower protective layer 88 is within the stated ranges, preferred results are obtained in various aspects such as the balance between wear resistance and heat conductivity (that is, recording sensitivity).

The lower protective layer 88 may comprise multiple sub-layers. In this case, multiple sub-layers may be formed of different materials or multiple sub-layers different in density may be formed of one material. Alternatively, the two steps may be combined to obtain sub-layers.

The thermal head of the invention is not limited to the one having the lower protective layer 88, but may have a one-layer protective film comprising only the carbon protective layer 90 which will be described below.

The thermal head 66 of the invention has the carbon protective layer 90 served as the protective film of the heat-generating resistor 84 and other parts. The carbon protective layer 90 has a higher or lower hardness on the side of the heat-generating resistor 84 (on the inner side) than on the surface side (on which the carbon protective layer 90 comes into contact with the thermal material A). The carbon protective layer has thus a hardness difference between the two sides, that is, a hardness gradient in the thickness direction.

This constitution provides a thermal head excellent in durability of which the carbon protective layer 90 sufficiently exhibits excellent corrosion resistance and wear resistance imparted thereto, and is protected from cracks and peeling-off caused by the heat shock and the thermal stress, the stress due to a difference in coefficient of thermal expansion between the carbon protective layer and the lower layer (lower protective layer 88 in the illustrated case), the mechanical impact due to an impurity or other factors as described above.

In the thermal head 66 of the invention, the hardness difference between the surface side and the inner side of the carbon protective layer 90 is not limited to any particular value but is preferably more than 100 kg/mm$^2$, particularly more than 500 kg/mm$^2$ in terms of Vickers hardness, in order to consistently provide the highly durable thermal head 66 without cracks nor peeling-off in the carbon protective layer 90.

The maximum limit of the hardness difference is not limited to any particular value but is preferably less than 2000 kg/mm$^2$, particularly less than 1500 kg/mm$^2$ in terms of Vickers hardness, since extremely large variation in hardness may often bring about easily cracks and peeling-off in the soft portions during thermal recording or any other inconvenience.

That is, according to the invention, the hardness difference between the surface side and the inner side of the carbon protective layer 90 is preferably in the range of from 100 kg/cm$^2$ to 2000 kg/mm$^2$, more preferably from 500 kg/mm$^2$ to 1500 kg/mm$^2$.

It should be noted that the variation in hardness of the carbon protective layer 90 in its thickness direction may be continuous or stepwise.

In view of cracks and peeling-off which may be caused inside the carbon protective layer 90 however, the variation in hardness in the thickness direction is preferably continuous. In the case of stepwise variation which provides the carbon protective layer 90 comprising multiple sub-layers, the hardness difference between the respective layers takes preferably a smaller value in order to reduce cracks, peeling-off or other defects.

The carbon protective layer 90 needs to have a sufficient hardness to serve as the protective film of the thermal head, although a higher hardness provides better performance. The hardness in the hardest portion is preferably more than 2000 kg/mm$^2$, more preferably more than 2500 kg/mm$^2$, most preferably more than 3000 kg/mm$^2$ in terms of Vickers hardness.

If the hardness of the carbon protective layer 90 is within the stated ranges, preferred results can be obtained in various aspects including wear resistance.

Moreover, the thickness of the carbon protective layer 90 is not limited to any particular value but it ranges preferably from 0.1 $\mu$m to 5 $\mu$m, more preferably from 1 $\mu$m to 3 $\mu$m, in the case of the glaze having the lower protective layer 88 as shown in FIG. 2. In the case where the lower protective layer 88 is not formed, it ranges preferably from 1 $\mu$m to 20 $\mu$m, more preferably from 2 $\mu$m to 10 $\mu$m.

If the thickness of the carbon protective layer 90 is within the stated ranges, preferred results can be obtained in various aspects including the balance between wear resistance and heat conductivity.

Methods of forming the carbon protective layer 90 are not limited to any particular way and known thick- and thin-film processes may be employed. Preferred examples include the plasma-assisted CVD using a hydrocarbon gas as a reactive gas to form a hard carbon film and the sputtering of a carbonaceous material (e.g., sintered carbon or glassy carbon) as a target to form a hard carbon film.

Figure 3:
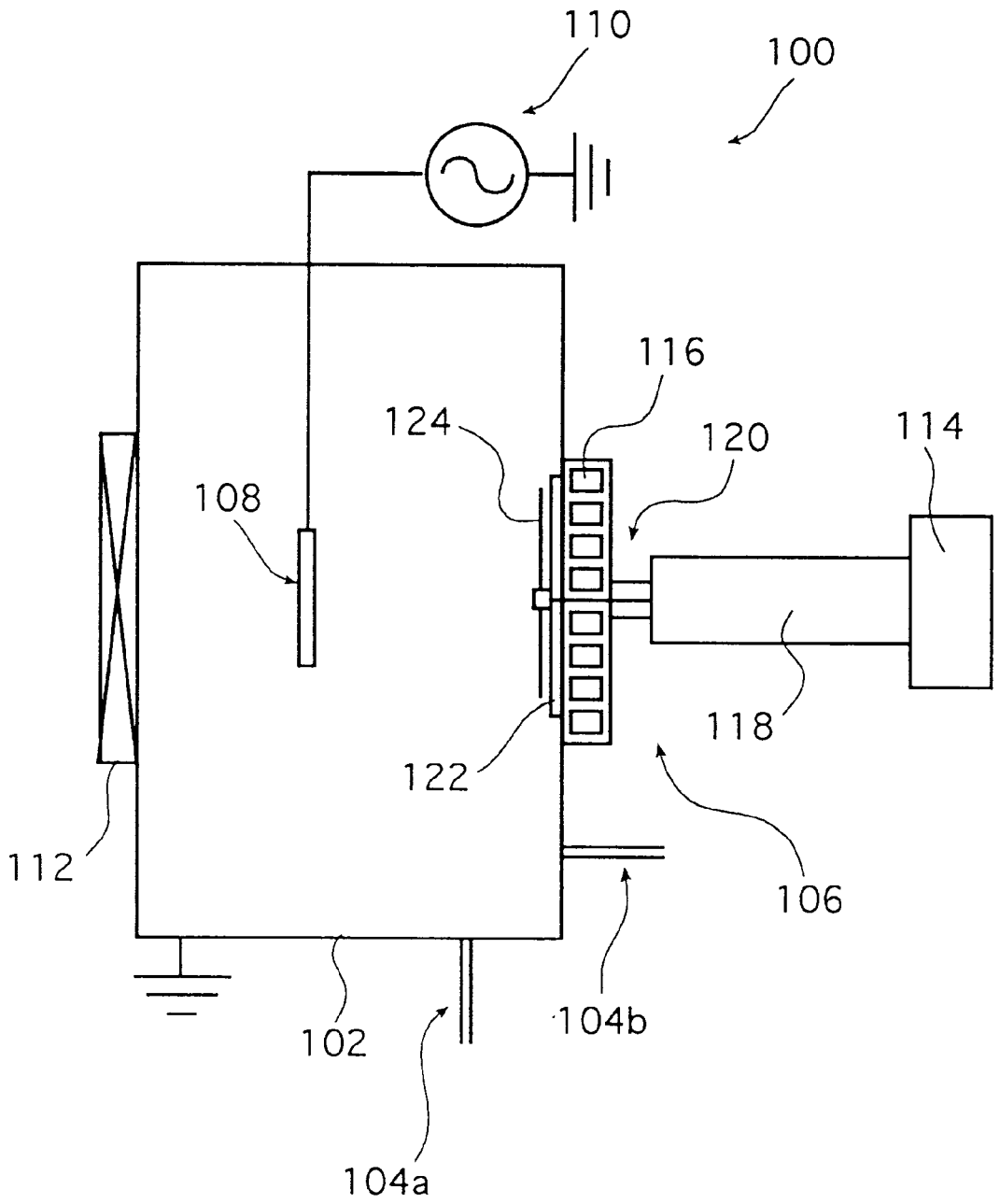
FIG. 3 shows the concept of an exemplary plasma-assisted CVD apparatus for forming a carbon protective layer on the thermal head of the invention.

FIG. 3 shows the concept of a plasma-assisted CVD apparatus to form the carbon protective layer 90. The CVD apparatus generally indicated by 100 comprises a vacuum chamber 102, a gas introducing section 104, plasma generating means 106, a substrate holder 108 and a substrate bias source 110 as the basic components.

The vacuum chamber 102 is preferably formed of a nonmagnetic material such as SUS 304 in order to keep unperturbed the magnetic field generated for plasma generation.

Preferably, the vacuum chamber 102 which is used to form the carbon protective layer 90 has pump-down means and presents such a seal property that an ultimate pressure of $2\times10^{-5}$ Torr or below, preferably $5\times10^{-6}$ Torr or below, is reached by initial pump-down whereas an ultimate pressure between $1\times10^{-4}$ Torr and $1\times10^{-2}$ Torr is reached during film deposition.

Pump-down means 112 is provided for the vacuum chamber 102 and a preferred example is the combination of a rotary pump, a mechanical booster pump and a turbomolecular pump; pump-down means using a diffusion pump or a cryogenic pump may be suitably used instead of the turbomolecular pump. The performance and number of pump-down means 112 may be determined as appropriate for various factors including the capacity of the vacuum chamber 102 and the nature and flow rate of a gas used during film deposition. In order to adjust the pumping speed, various adjustment designs may be employed, such as bypass pipes that provide for evacuation resistance adjustment and orifice valves which are adjustable in the degree of opening.

Those sites of the vacuum chamber 102 where plasma develops or an arc is produced by plasma generating electromagnetic waves may be covered with an insulating member, which may be made of insulating materials including MC nylon, Teflon (PTFE), polyphenylene sulfide (PPS), polyethylene naphthalate (PEN) and polyethylene terephthalate (PET). If PEN or PET is used, care must be taken to insure that the degree of vacuum will not decrease upon degassing of such insulating materials.

The CVD apparatus 100 comprises the gas introducing section 104 consisting of two parts 104*a* and 104*b*, the former being a site for introducing a plasma generating gas and the latter for introducing a reactive gas, into the vacuum chamber 102 through stainless steel pipes or the like that are vacuum sealed with O-rings or the like at the inlet. The amounts of the gases being introduced are controlled by known means such as a mass flow controller.

Both gas introducing parts 104*a* and 104*b* are basically so adapted as to displace the introduced gases to the neighborhood of the plasma-generating region in the vacuum chamber 102. The blowout position, particularly that of the reactive gas introducing part 104*b*, has a certain effect on the thickness profile of the carbon protective layer to be formed and, hence, it is preferably optimized in accordance with various factors such as the geometry of the substrate (the glaze of the thermal head 66).

Examples of the plasma generating gas for producing the carbon protective layer 90 are inert gases such as helium, neon, argon, krypton and xenon, among which argon gas is used with particular advantage because of price and easy availability.

Examples of the reactive gas for producing the carbon protective layer 90 are the gases of hydrocarbon compounds such as methane, ethane, propane, ethylene, acetylene and benzene.

It is required with the gas introducing parts 104*a* and 104*b* that the sensors in the mass flow controllers be adjusted (calibrated) in accordance with the gases to be introduced.

In plasma-assisted CVD to form the carbon protective layer 90, the plasma generating means may utilize various discharges such as direct current (DC) glow discharge, radio-frequency (RF) discharge, DC arc discharge and microwave ECR discharge, among which DC arc discharge and microwave ECR discharge have high enough plasma densities to be particularly advantageous for high-speed film deposition.

The illustrated CVD apparatus 100 utilizes microwave ECR discharge and the plasma generating means 106 comprises a microwave source 114, magnets 116, a microwave guide 118, a coaxial transformer 120, a dielectric plate 122 and a radial antenna 124 and the like.

In DC glow discharge, a plasma is generated by applying a negative DC voltage between the substrate and the electrode. The DC power supply for use in DC glow discharge has an output of about 1 to 10 kW and a device having the necessary and sufficient output to produce the carbon protective layer 90 may appropriately be selected. For anti-arc and other purposes, a DC power supply pulse-modulated for 2 to 20 kHz is also applicable with advantage.

In RF discharge, a plasma is generated by applying a radio-frequency voltage to the electrodes via a matching box, which performs impedance matching such that the reflected wave of the radio-frequency voltage is no more than 25% of the incident wave. A suitable RF power supply for RF discharge may be selected from those in commercial use which produce outputs at 13.56 MHz having powers in the range from about 1 kW to about 10 kW which are necessary and sufficient to produce the carbon protective layer 90. A pulse-modulated RF power supply is also useful for RF discharge.

In DC arc discharge, a hot cathode is used to generate a plasma. The hot cathode may typically be formed of tungsten or lanthanum boride ($LaB_6$). DC arc discharge using a hollow cathode can also be utilized. A suitable DC power supply for use in DC arc discharge may be selected from those which produce outputs at about 10 to 200 A having powers in the range from about 1 kW to about 10 kW which are necessary and sufficient to produce the carbon protective layer 90.

In microwave ECR discharge, a plasma is generated by the combination of microwaves and an ECR magnetic field and, as already mentioned, the illustrated CVD apparatus 100 utilizes microwave ECR discharge for plasma generation.

The microwave source 114 may appropriately be selected from those in commercial use which produce outputs at 2.45 GHz having powers in the range from about 1 kW to 3 kW which are necessary and sufficient to produce the carbon protective layer 90.

To generate an ECR magnetic field, permanent magnets or electromagnets which are capable of forming the desired magnetic field may appropriately be employed and, in the illustrated case, Sm—Co magnets are used as the magnets 116. Consider, for example, the case of using microwaves at 2.45 GHz; since the ECR magnetic field has a strength of 875 G (gauss), the magnets 116 may be those which produce a magnetic field with intensities of 500 to 2,000 G in the plasma generating region.

Microwaves are introduced into the vacuum chamber 102 using the microwave guide 118, the coaxial transformer 120, the dielectric plate 122, etc. It should be noted that the state of magnetic field formation and the microwave introducing path, both affecting the thickness profile of the carbon protective layer 90 to be deposited, are preferably optimized to provide a uniform thickness for the carbon protective layer 90.

The substrate holder 108 fixes the thermal head 66 to which the heat sink 67 is fixed or not fixed, or the glaze and other portions detached from the thermal head 66 by known fixing means such as a clamp or a jig in such a way that the glaze used as the substrate of film deposition is held in a face-to-face relationship with the radial antenna 124. If necessary, the glaze may be adapted to be rotatable or otherwise movable relative to the plasma generating means 106.

The distance between the substrate (the surface of the glaze) and the radial antenna 124 (the plasma generating section) is not limited to any particular value and a distance that provides a uniform thickness profile may be set appropriately within the range from about 20 mm to about 200 mm.

When forming the carbon protective layer 90, a mask for controlling the film deposition area may be used if necessary. Then, a plate-like masking member made of a metal such as SUS 304 or aluminum, or a resin such as Teflon or the like may be prepared and used for masking the areas to be protected from film deposition.

In order to form the carbon protective layer by plasma-assisted CVD, film deposition has to be performed with a negative bias voltage being applied to the substrate. The substrate bias source 110 is used to supply the required bias voltage.

The radio-frequency voltage is not limited to the self-bias voltage, but the latter is preferably used, since the carbon protective layer 90 has a high electrical resistance. The self-bias voltage is a negative DC component produced when applying a radio-frequency voltage in the plasma. When forming the carbon protective layer, the self-bias voltage in the range of −100 to −500 V is usually used. A suitable RF power supply may be selected from those in commercial use which produce outputs at 13.56 MHz having powers in the range from about 1 kW to about 5 kW.

When applying a radio-frequency voltage to the substrate, a matching box is preferably used for impedance matching between the substrate and the RF power supply. The matching box may be of manual control type or automatic control type and a variety of commercially available products can be used.

Instead of the radio-frequency self-bias voltage, a DC power supply pulse-modulated for 2 to 20 kHz is also applicable. In this case, the voltage to be applied is also in the range of from −100 to −500 V.

In the plasma-assisted CVD, the hardness of the carbon protective layer 90 to be formed can be adjusted by controlling the substrate bias voltage.

In the carbon layer formed by the plasma-assisted CVD while applying a substrate bias voltage, the hardness increases in general with the increase of the negative substrate bias voltage and takes the largest value in the voltage range of −200 to −300 V. In negative values exceeding the stated range however, the hardness is reduced. Therefore, if the substrate bias voltage at the beginning of film deposition is set to about −100 V and gradually changed to −300 V until the end of film deposition, a more or less soft layer portion is first formed and the layer portion formed at the end of film deposition becomes hardest. The hardness is increased from the inner side (heater side) toward the surface side. Thus, the carbon protective layer 90 can be obtained having a hardness difference, that is, a hardness gradient in its thickness direction. On the other hand, if the substrate bias voltage at the beginning of film deposition is set to about −300 V and changed to −100 V until the end of film deposition, the carbon protective layer 90 of which the hardness is increased from the surface side toward the inner side can be obtained.

Continuous variation of the substrate bias voltage provides the carbon protective layer 90 having a continuous hardness variation, whereas stepwise variation provides the carbon protective layer 90 having a stepwise hardness variation similar to the case of the multiple sub-layers.

The methods for setting and controlling various factors including the hardness and the hardness difference of the carbon protective layer 90 to be formed are not limited to any particular way but the carbon protective layer 90 having a desired hardness and hardness difference (hardness gradient) can be formed for example by a method in which the relationship between the substrate bias voltage and the film hardness is previously determined by experiments or the like to adjust accordingly the substrate bias voltage in the forming process of the carbon protective layer 90.

Another example of the hardness adjusting method of the carbon protective layer 90 is a method of adjusting the hydrogen content in the film.

In the illustrated embodiment in which the carbon protective layer 90 is formed by the plasma-assisted CVD using a hydrocarbon gas as a reactive gas, a layer having the highest hardness can be obtained at a hydrogen content in the film of about 30% by atom. Therefore, the carbon protective layer 90 having a hardness difference can be formed by selecting a reactive gas depending on the hydrogen atom content in the molecule.

The surface of the substrate (glaze), or the surface of the illustrated lower protective layer 88 is preferably etched with a plasma prior to the formation of the carbon protective layer 90 in order to improve its adhesion to the carbon protective layer 90.

The etching methods include a method in which a radio-frequency voltage is applied via the matching box while generating a plasma by said plasma generating means 106, and a method in which a plasma is directly generated by a radio-frequency voltage and is used for etching.

A suitable RF power supply may be selected from those in commercial use which produce outputs at 13.56 MHz having powers in the range from about 1 kW to about 5 kW. The intensity of etching may be determined with the bias voltage to the substrate being used as a guide; an optimal value may be selected from the range of −100 to −500 V.

Figure 4:
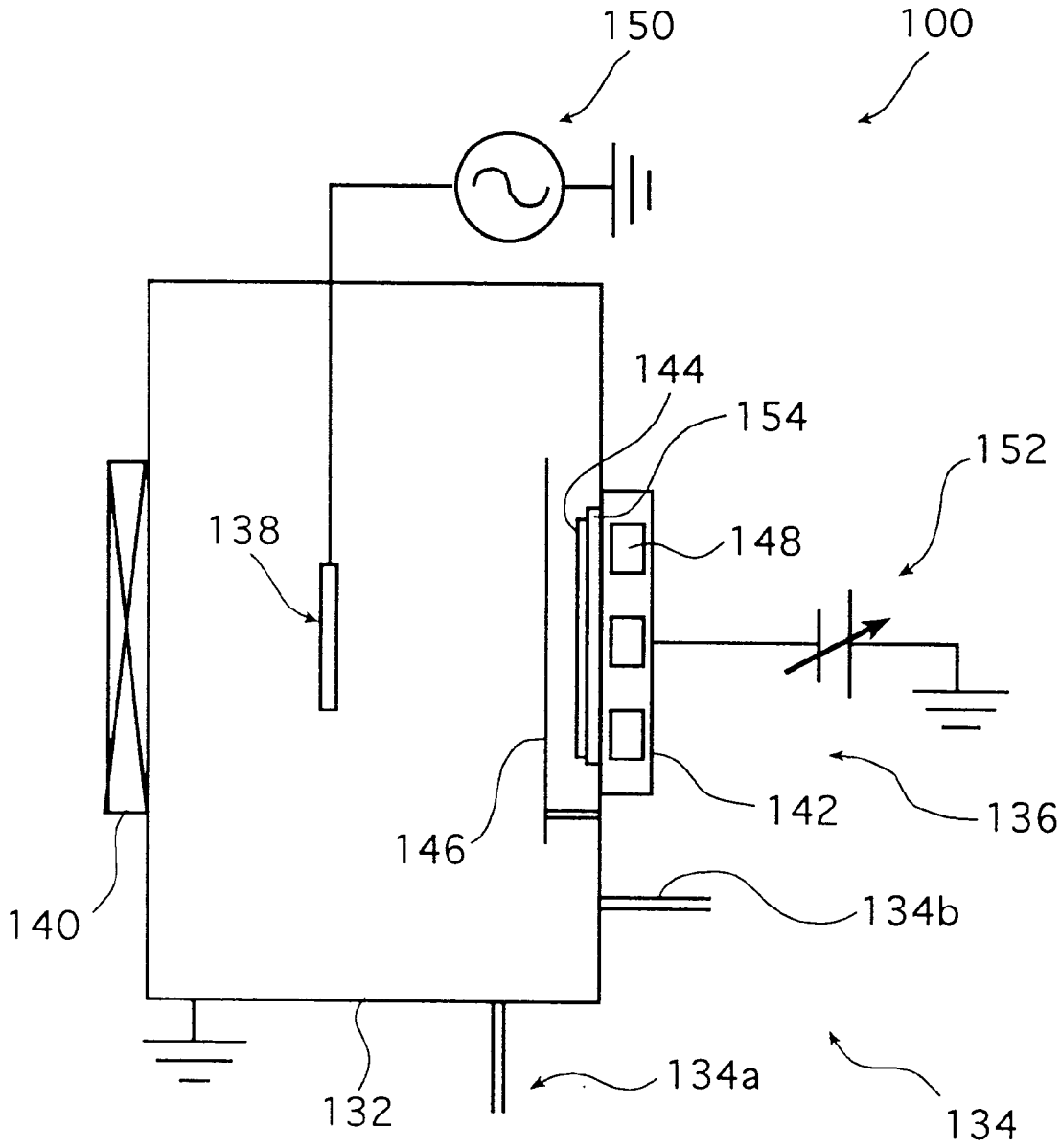
FIG. 4 shows the concept of an exemplary sputtering apparatus for forming a carbon protective layer on the thermal head of the invention.

FIG. 4 shows the concept of a sputtering apparatus to form the carbon protective layer 90.

The sputtering apparatus generally indicated by 130 comprises a vacuum chamber 132, a gas introducing section 134, sputter means 136 and a substrate holder 138 as the basic components.

The vacuum chamber 132 in which sputtering is performed to form the carbon protective layer, pump-down means 140 provided therefor, and adjusting means for pumping speed are advantageously exemplified by those having a similar structure to that of said CVD apparatus 100.

The gas introducing section 134 consists of two parts 134*a* and 134*b*, the former being a site for introducing a plasma generating gas and the latter for introducing hydrogen gas, into the vacuum chamber 132 through stainless steel pipes or the like that are vacuum sealed with O-rings or the like, as in the gas introducing section 104 of said CVD apparatus 100. The amounts of the gases being introduced are controlled by known means such as a mass flow controller. The gas introducing section 134 is basically so adapted as to displace the introduced gas to the neighborhood of the plasma-generating region in the vacuum chamber 132. The blowout position is preferably optimized to be such that the profile of the generated plasma will not be adversely affected.

Examples of the plasma generating gas for producing the carbon protective layer 90 are inert gases such as helium, neon, argon, krypton and xenon, among which argon gas is used with particular advantage because of its price and easy availability.

In the embodiment utilizing sputtering to form the carbon protective layer 90, a plasma generating gas and hydrogen gas are introduced into the chamber while adjusting the flow rate thereof to control the hardness of the layer. The carbon protective layer 90 having a hardness difference (hardness gradient) between the surface side and the inner side can be thus formed by changing the hydrogen gas flow rate during film deposition.

In the case where argon is used as the plasma generating gas for example, the hardest layer can be obtained when the hydrogen gas flow rate is 5 to 10% of the argon flow rate, and the layer is softened with the increase of the hydrogen content.

Therefore, if the hydrogen gas flow rate at the beginning of film deposition is set to about 20% of the argon gas flow rate and is gradually changed to about 5% until the end of film deposition, can be obtained the carbon protective layer 90 having a hardness increased from the inner side toward the surface side, that is, a hardness gradient, as in the aforementioned plasma-assisted CVD. On the other hand, if the hydrogen gas flow rate at the beginning of film deposition is set to about 5% of the argon gas flow rate and is changed to about 20% until the end of film deposition, can be obtained the carbon protective layer 90 of which the hardness is increased from the surface side toward the inner side.

Continuous variation of the hydrogen flow rate makes the hardness variation of the carbon protective layer 90 continuous and stepwise variation thereof makes it stepwise, as in the aforementioned case.

The method for setting and controlling the hardness of the carbon protective layer 90 is not limited to any particular way but the carbon protective layer 90 having desired hardness and hardness difference (hardness gradient) can be formed by a method in which the relationship between the hydrogen gas flow rate and the film hardness is previously determined by experiments or the like to adjust accordingly the hydrogen gas flow rate during film deposition.

In view of the hardness or other factors of the carbon protective layer 90, the hydrogen gas flow rate is preferably in the range of from 2 to 5% of the argon gas flow rate when argon was used as the plasma generating gas.

Hydrogen gas is preferably introduced into the chamber by means of the introducing pipe independent of the pipe for plasma generating gas as shown in FIG. 4, but a common introducing pipe may be used to introduce both the plasma generating gas and the hydrogen gas, if there is a limitation in the structure of the apparatus.

To effect sputtering, a target 144 to be sputtered is placed on the cathode 142, which is rendered at negative potential and a plasma is generated on the surface of the target 144, whereby atoms are struck out of the target 144 and deposit on the surface on the opposed substrate (i.e., on the surface of the glaze of the thermal head 66=on the surface of the lower protective layer 88) to form the film.

The sputter means 136 comprises essentially the cathode 142, the area where the target 144 is to be placed, a shutter 146 and a DC power supply 152.

In order to generate a plasma on the surface of the target 144, the negative side of the DC power supply 152 is connected directly to the cathode 142, which is supplied with a DC voltage of about −300 to −1,000 V. The DC power supply 152 has an output of about 1 to 10 kW and a device having the necessary and sufficient output to produce the carbon protective layer 90 may appropriately be selected. The geometry of the cathode 142 may be determined as appropriate for various factors such as the geometry of the substrate on which the carbon protective layer 90 is to be formed. For anti-arc and other purposes, a negative DC power supply pulse-modulated for 2 to 20 KHz is also applicable with advantage.

RF power supplies are also useful to generate plasmas. If an RF power supply is to be used, a radio-frequency voltage is applied to the cathode 142 via a matching box so as to generate a plasma. The matching box performs impedance matching such that the reflected wave of the radio-frequency voltage is no more than 25% of the incident wave. A suitable RF power supply may be selected from those in commercial use which produce outputs at 13.56 MHz having powers in the range of from about 1 kW to about 10 kW which are necessary and sufficient to produce the carbon protective layer 90.

The target 144 may be secured directly to the cathode 142 with In-based solder or by mechanical fixing means but usually a backing plate 154 made of oxygen-free copper, stainless steel or the like is first fixed to the cathode 142 and the target 144 is then attached to the backing plate 154 by the methods just described above. The cathode 142 and the backing plate 154 are adapted to be water-coolable so that the target 144 is indirectly cooled with water.

The target 144 used to form the carbon protective layer 90 is preferably made of sintered carbon, glassy carbon or the like. The geometry of the target 114 may be determined as appropriate for the geometry of the substrate.

Another method that can advantageously be employed to form the carbon protective layer 90 is magnetron sputtering, in which magnets 149 such as permanent magnets or electromagnets are placed within the cathode 142 and a sputtering plasma is confined within a magnetic field formed on the surface of the target 144. Magnetron sputtering is preferred since it achieves high deposition rates.

The shape, position and number of the permanent magnets or electromagnets to be used and the strength of the magnetic field to be generated are determined as appropriate for various factors such as the thickness and its profile of the carbon protective layer 90 to be formed and the geometry of the target 144. Using permanent magnets such as Sm—Co and Nd—Fe—B magnets which are capable of producing intense magnetic fields is preferred for several reasons including the high efficiency of plasma confinement.

The substrate holder 138 is basically the same as the substrate holder 108 positioned in the CVD apparatus 100 described above and fixes the thermal head 66 in position by known means so that the substrate glaze is held in a predetermined face-to-face relationship with the cathode 142. If necessary, the glaze may be adapted to be rotatable or otherwise movable relative to the cathode 142 and a suitable design can be selected appropriately depending on several factors including the substrate size.

The distance between the substrate and the target 144 is not limited to any particular value and a distance that provides a uniform thickness profile may be set appropriately within the range from about 20 mm to about 200 mm.

A negative bias voltage is applied to the substrate (the lower protective layer 88 in the illustrated case) to obtain the carbon protective layer 90. A bias source 150 is used to supply the required bias voltage.

The bias voltage is not limited to any particular type but a radio-frequency self-bias voltage is preferably used as in the CVD described above. The RF power supply as used in the CVD is applicable and the matching box is also preferably used. Instead of the radio-frequency self-bias voltage, a DC power supply pulse-modulated for 2 to 20 kHz is also applicable with advantage. In this case, the voltage to be applied is also in the range of from −100 to −500 V.

When forming the carbon protective layer 90, the surface of the lower protective layer 88 is preferably etched with a plasma prior to the formation of the carbon protective layer 90 in order to improve its adhesion to the lower layer (lower protective layer 88).

The etching methods include a method in which a radio-frequency voltage is applied to the substrate via the matching box while generating a plasma, and a method in which a plasma is directly generated by a radio-frequency voltage and is used for etching. The plasma generating means and the RF power supply as described above can be used. The intensity of etching may be determined with the bias voltage to the substrate being used as a guide; usually, an optimal value may be selected from the range of −100 to −500 V.

On the foregoing pages, the thermal head and the method of manufacturing the thermal head have been described in detail but the present invention is in no way limited to the stated embodiments and various improvements and modifications can of course be made without departing from the spirit and scope of the invention.

As described above in detail, the present invention provide a thermal head having a protective layer which is significantly protected from corrosion and wear and is also advantageously protected from cracks and peeling-off due to heat and mechanical impact, and which allows the thermal head to have a sufficient durability to exhibit a high reliability over an extended period of time, thereby ensuring that the thermal recording of high-quality images is performed consistently over an extended period of operation.

The invention will be further illustrated by means of the following specific examples.

EXAMPLE 1

A plasma-assisted CVD apparatus 100 shown in FIG. 3 was set up in the following manner.

a. Vacuum Chamber 102

This vacuum chamber was made of SUS 304 and had a capacity of 0.5 $m^3$; pump-down means 112 comprised one unit each of a rotary pump having a pumping speed of 1,500 L/min, a mechanical booster pump having a pumping speed of 12,000 L/min and a turbomolecular pump having a pumping speed of 3,000 L/sec. An orifice valve was fitted at the suction inlet of the turbomolecular pump to allow for 10 to 100% adjustment of the degree of opening.

b. Gas Introducing Section 104

This gas introducing section was composed of a mass flow controller permitting a maximum flow rate of 100 to 500 sccm and a stainless steel pipe having a diameter of 6 mm. The joint between the stainless steel pipe and the vacuum chamber 102 was vacuum sealed with an O-ring.

Argon gas was used as a plasma generating gas.

c. Plasma Generating Means 106

A microwave ECR plasma generating apparatus using a microwave source 114 oscillating at a frequency of 2.45 GHz and producing a maximal output of 3.0 kW was employed. The generated microwave was guided to the neighborhood of the vacuum chamber 102 by means of a microwave guide 118, passed through a coaxial transformer 120 and directed to a radial antenna 124 in the vacuum chamber 102.

The dielectric plate 122 used was in a rectangular form having a width of 800 mm and a height of 200 mm. The microwave passing through the microwave guide 118 was divided into four on the halfway and introduced into the vacuum chamber 102 through 4 portions in the dielectric plate 122.

A magnetic field for ECR was produced by arranging a plurality of Sm—Co magnets used as the magnets 116 in a pattern to conform to the shape of the dielectric plate 122.

d. Substrate Holder 108

The substrate (that is, the glaze on the thermal head) was held in a face-to-face relationship with the plasma generating section and was so adapted that the distance between the substrate and the radial antenna 124 could be varied between 50 mm and 150 mm.

That area of the substrate in which the thermal head was held was set at a floating potential in order to enable the application of an etching radio-frequency voltage.

e. Substrate Bias Source 110

An RF power supply served as the substrate bias source 110 was connected to the substrate holder 108 via a matching box.

The RF power supply had a frequency of 13.56 MHz and could produce a maximal output of 3 kW. It was also adapted to be such that by monitoring the self-bias voltage, the RF output could be adjusted over the range of −100 to −500 V.

In the CVD apparatus 100, the substrate bias source 110 also serves as the substrate etching means.

Fabrication of Thermal Head

Using the CVD apparatus 100 thus set up, a thermal head was fabricated in the following manner.

A commercial thermal head (Model KGT-260-12MPH8 of KYOCERA CORP.) was used as the base. The thermal head had a silicon nitride ($Si_3N_4$) film formed in a thickness of 11 $\mu$m as a protective layer on the surface of the glaze. Therefore, in Example 1, the silicon nitride film served as the lower protective layer 88, which was to be overlaid with the carbon protective layer 90 to thereby form the thermal head 66 having two protective layers.

Thermal head 66 was secured to the substrate holder 108 in the vacuum chamber 102 such that the glaze of the thermal head would be in a face-to-face relationship with the radial antenna 124. The distance between the substrate (surface of the glaze) and the radial antenna 124 was set to 100 mm. All areas of the thermal head other than those where the carbon protective layer was to be formed (namely, the non-glaze areas) were previously masked.

After the thermal head was fixed in position, the vacuum chamber 102 was pumped down to an internal pressure of $5\times10^{-6}$ Torr.

With continued pump-down, argon gas was introduced through the gas introducing section 104*a* and the pressure in the vacuum chamber 102 was adjusted to $1.0\times10^{-3}$ Torr by means of the orifice valve fitted on the turbomolecular pump.

Subsequently, the microwave source 114 was driven to introduce each microwave at a power of 400 W through 4 portions in the dielectric plate into the vacuum chamber 102 where a microwave ECR plasma was generated. The substrate bias source 110 was also driven to apply a radio-frequency bias voltage to the substrate and the lower protective layer 88 (silicon nitride film) was etched for 2 min. at a self-bias voltage of −200 V.

After the end of etching, the plasma-assisted CVD was performed by introducing methane gas to adjust the internal pressure in the vacuum chamber 102 at $3.0\times10^{-3}$ Torr, with the radio-frequency voltage being kept applied by the self-bias voltage. Thus, the thermal head 66 having the carbon protective layer 90 formed in a thickness of 1 $\mu$m was fabricated. The same procedure was repeated to fabricate two additional samples of thermal head having the carbon protective layer 90 formed in thickness of 2 μm and 3 μm.

In this example, the relationship between the hardness of the carbon protective layer 90 to be formed in this system and the self-bias voltage during film deposition was previously determined to control accordingly the hardness and the hardness difference of the carbon protective layer 90 to be formed.

Specifically, in every case where the film thickness is 1 μm, 2 μm or 3 μm, the self-bias voltage at the beginning of film deposition was set to −100 V and continuously changed to −200 V until the end of film deposition to thereby obtain the carbon protective layer 90 of which the Vickers hardness changes continuously from 1500 kg/mm$^2$ at the beginning of film deposition (inner side) to 2500 kg/mm$^2$ at the end of film deposition (surface side) by a hardness difference of 1000 kg/mm$^2$.

To control the thickness of the carbon protective layer 90 being formed, the deposition rate was determined previously and the time required to reach a specified film thickness was calculated.

Evaluation of Performance

Using the three samples of thermal head according to the present invention and 5000 sheets of thermal material of B4 size (dry image recording film CR-AT of Fuji Photo Film Co., Ltd.), thermal recording test was performed.

Consequently, in every sample of thermal head having the carbon protective layer 90 deposited thereon in thickness of 1 μm, 2 μm and 3 μm, cracks and peeling-off were not generated therein and any wear was hardly confirmed.

EXAMPLE 2

The procedure of Example 1 was repeated to fabricate additional three samples of thermal head having the carbon protective layer 90 deposited thereon in thickness of 1 μm, 2 μm and 3 μm, except that argon gas used as the reactive gas was replaced by acetylene gas.

The hardness and hardness difference of the carbon protective layer 90 were also controlled as in Example 1. Specifically, in the respective three samples, the self-bias voltage at the beginning of film deposition was set to −100 V and continuously changed to −200 V until the end of film deposition to thereby obtain the carbon protective layer 90 of which the Vickers hardness changes continuously from 1500 kg/mm$^2$ at the beginning of film deposition (inner side) to 2500 kg/mm$^2$ at the end of film deposition (surface side) by a hardness difference of 1000 kg/mm$^2$.

Evaluation of Performance

The performance of the three samples of thermal head according to the present invention was evaluated as in Example 1.

Consequently, in every sample of thermal head, cracks and peeling-off were not generated in the carbon protective layer 90 and any wear was hardly confirmed.

Additional samples of thermal head were fabricated by forming the carbon protective layers 90 in thickness of 1, 2 and 3 μm under the same conditions as in Examples 1 and 2, except for the following differences: no etching was done; the pressure in the vacuum chamber 102 during etching was changed to $0.8\times10^{-3}$ Torr or $5.0\times10^{-3}$ Torr; or the pressure in the vacuum chamber 102 during film deposition was only changed to $2.0\times10^{-3}$ Torr or $5.0\times10^{-3}$ Torr. These samples were subjected to the same test for performance evaluation and good results were obtained as in Examples 1 and 2.

EXAMPLE 3

A sputtering apparatus 130 shown in FIG. 4 was set up. The vacuum chamber 132, the gas introducing section 134 and the substrate holder 138 are those used in Example 1. The other parts are described below in detail.

a. Sputter Means 106

The cathode 142 used was in a rectangular form having a width of 600 mm and a height of 100 mm, with Sm—Co magnets being incorporated as magnets 148. The backing plate 154 was a rectangular sintered carbon member, which was attached to the cathode 142 with In-based solder. The interior of the cathode 142 was water-cooled to cool the magnets 148, the cathode 142 and the rear side of the backing plate 154.

The DC power supply 152 was of a DC type at negative potential capable of producing a maximal output of 8 kW. The negative side was connected to the cathode 142. This DC power supply was adapted to be capable of pulse modulation at frequencies in the range of 2 to 10 kHz.

b. Bias Source 150

An RF power supply was connected to the substrate holder 138 via a matching box. The RF power supply had a frequency of 13.56 MHz and could produce a maximal output of 3 kW. It was also adapted to be such that by monitoring the self-bias voltage, the RF output could be adjusted over the range of −100 to −500 V.

The bias source 150 is also used as the etching means.

Fabrication of Thermal Head

Using the sputtering apparatus 130 thus set up, the same thermal head (Model KGT-260-12MPH8 of KYOCERA CORP.) as in Example 1 was revamped by forming the carbon protective layer 90 on the surface of the glaze. That is, this thermal head has a two-layer protective film comprising the lower protective layer 88 made of silicon nitride and the carbon protective layer 90.

Thermal head 66 was secured to the substrate holder 138 in the vacuum chamber 132 such that the glaze would be in a face-to-face relationship with the target 144. The distance between the substrate (surface of the glaze) and the surface of the target 144 was set to 100 mm. The non-glaze areas were previously masked as in Example 1.

After the thermal head was fixed in position, the vacuum chamber 132 was pumped down to an internal pressure of $5\times10^{-6}$ Torr.

With continued pump-down, argon gas was introduced through the gas introducing section 134*a* and the pressure in the vacuum chamber 132 was adjusted to $5.0\times10^{-3}$ Torr by means of the orifice valve fitted on the turbomolecular pump. Subsequently, the bias supply 150 was driven to apply a radio-frequency voltage to the substrate and the lower protective layer (silicon nitride film) 88 was etched for 10 min. at a self-bias voltage of −200 V.

After the end of etching, a sintered graphite member was fixed as the target 144 on the backing plate 154 (i.e., attached by means of In-based solder) and a DC power of 0.5 kW was applied to the target 144 for 5 min. with the shutter 146 being closed and the argon gas flow rate and the orifice valve so adjusted as to maintain the internal pressure in the vacuum chamber 132 at $5.0\times10^{-3}$ Torr.

Subsequently, with the internal pressure in the vacuum chamber 132 kept at the stated level, the DC power to apply to the target 144 was raised to 5 kW. A radio-frequency self-bias voltage of −200 V was applied to the substrate, followed by opening of the shutter 146. At the same time, the introduction of hydrogen gas through the gas introducing section 134*b* into the chamber was started to fabricate the thermal head 66 having the carbon protective layer 90 deposited on the glaze in a thickness of 1 μm. The same procedure was repeated to fabricate two additional samples of thermal head having the carbon protective layers deposited in thickness of 2 μm and 3 μm.

In this example, the relationship between the hardness of the carbon protective layer 90 to be formed in this system and the hydrogen gas flow rate in the process of film deposition (ratio of hydrogen gas flow rate to argon gas flow rate) was previously determined to control accordingly the hardness of the carbon protective layer 90 to be formed.

Specifically, in every case where the film thickness is 1 μm, 2 μm or 3 μm, the hydrogen gas flow rate at the beginning of film deposition was set to 15% of the argon gas flow rate and continuously changed to 5% until the end of film deposition to thereby obtain the carbon protective layer 90 of which the Vickers hardness changes continuously from 1200 kg/mm$^2$ at the beginning of film deposition (inner side) to 2200 kg/mm$^2$ at the end of film deposition (surface side) by a hardness difference of 1000 kg/mm$^2$.

To control the thickness of the carbon protective layer 90 being formed, the deposition rate was determined previously and the time required to reach a specified film thickness was calculated.

Evaluation of Performance

The performance of the three samples of thermal head according to the present invention was evaluated as in Example 1.

Consequently, in every sample of thermal head, cracks and peeling-off were not generated in the carbon protective layer 90 and any wear was hardly confirmed.

EXAMPLE 4

The procedure of Example 3 was repeated to fabricate additional three samples of thermal head having the carbon protective layer 90 deposited thereon in thickness of 1 μm, 2 μm and 3 μm, except that a glassy carbon member was used as the target.

The hardness and hardness difference of the carbon protective layer 90 were also controlled as in Example 3. Specifically, in the respective three samples, the hydrogen gas flow rate at the beginning of film deposition was set to 15% of the argon gas flow rate and continuously changed to 5% until the end of film deposition to thereby obtain the carbon protective layer 90 of which the Vickers hardness changes continuously from 1200 kg/mm$^2$ at the beginning of film deposition (inner side) to 2200 kg/mm$^2$ at the end of film deposition (surface side) by a hardness difference of 1000 kg/mm$^2$.

Evaluation of Performance

The performance of the three samples of thermal head according to the present invention was evaluated as in Example 1.

Consequently, in every sample of thermal head, cracks and peeling-off were not generated in the carbon protective layer 90 and any wear was hardly confirmed.

Additional samples of thermal head were fabricated by forming the carbon protective layers 90 in thickness of 1, 2 and 3 μm under the same conditions as in Examples 3 and 4, except for the following differences: no etching was done; the pressure in the vacuum chamber 132 during etching was only changed to $8.0\times10^{-3}$ Torr; or the pressure in the vacuum chamber 132 during film deposition was only changed to $3.0\times10^{-3}$ Torr or $8.0\times10^{-3}$ Torr. These samples were subjected to the same test for performance evaluation and good results were obtained as in Examples 3 and 4.

Comparative Example

The following various samples of thermal head were prepared:

a. thermal head used as the base in each Example (Model KGT-260-12MPH8 of KYOCERA CORP.);

b. thermal head fabricated as in Example 1 except that the radio-frequency self-bias voltage during film deposition was made constant at −200 V; the thermal head having a uniform carbon protective film of which the thickness is 2 μm and the Vickers hardness 2500 kg/mm$^2$;

c. thermal head fabricated as in Example 3 except that the ratio of hydrogen gas flow rate to argon gas flow rate during film deposition was made constant at 5%; the thermal head having a uniform carbon protective film of which the thickness is 2 μm and the Vickers hardness 2200 kg/mm$^2$.

Evaluation of Performance

The performance of the three samples of thermal head was evaluated as in Example 1.

Consequently, the thermal heads "b" and "c" had cracks and peeling-off in the carbon protective layer before recording 5000 sheets of paper, and the silicon nitride protective layer on the thermal head "a" was worn by 2 μm.

These results clearly demonstrate the effectiveness of the present invention.

What is claimed is:

1. A thermal head having a protective film of a heater which comprises a carbon protective layer having a hardness difference from a surface side to an inner side of said carbon protective layer in its thickness direction, wherein said hardness difference is from 100 kg/mm$^2$ to 1500 kg/mm$^2$ in terms of Vickers hardness.

2. The thermal head according to claim 1 wherein at least one ceramic-based protective layer is provided as a lower protective layer on the heater side of said carbon protective layer.

3. The thermal head according to claim 1, wherein said hardness difference is from 500 kg/mm$^2$ to 1500 kg/mm$^2$ in terms of Vickers hardness.

4. The thermal head according to claim 1, wherein said carbon protective layer has a hardness in a hardest portion which is more than 2000 kg/mm$^2$ in terms of Vickers hardness.

5. The thermal head according to claim 4, wherein said hardness in the hardest portion is more than 2500 kg/mm$^2$ in terms of Vickers hardness.

6. The thermal head according to claim 4, wherein said hardness in the hardest portion is more than 3000 kg/mm$^2$ in terms of Vickers hardness.

7. A thermal head in which a carbon protective layer having a hardness difference from a surface side to an inner side of said carbon protective layer in its thickness direction is formed on a surface of a heater by applying a radio-frequency bias voltage to the surface of the heater while changing the voltage value, in an atmosphere in which a carbon-based gas is ionized, and wherein said hardness difference is from 100 kg/mm$^2$ to 1500 kg/mm$^2$ in terms of Vickers hardness.

8. The thermal head according to claim 7, wherein said carbon protective layer has a hardness in a hardest portion which is more than 2000 kg/mm$^2$ in terms of Vickers hardness.

9. A thermal head in which a carbon protective layer having a hardness difference from a surface side to an inner side of said carbon protective layer in its thickness direction is formed on a surface of a heater by producing a plasma on the surface of the heater in a hydrogen gas atmosphere while evaporating a carbon-based solid, applying a radio-frequency bias voltage and changing a flow rate of said hydrogen gas, and wherein said hardness difference is from 100 kg/mm$^2$ to 1500 kg/mm$^2$ in terms of Vickers hardness.

10. The thermal head according to claim 9, wherein said carbon protective layer has a hardness in a hardest portion which is more than 2000 kg/mm$^2$ in terms of Vickers hardness.

11. A thermal head having a protective film of a heater which comprises a carbon protective layer having a hydrogen concentration that is decreasing with increasing thickness of the protective film, wherein said carbon protective layer has a hardness difference from a surface side to an inner side of said carbon protective layer in its thickness direction which is from 100 kg/mm$^2$ to 1500 kg/mm$^2$ in terms of Vickers hardness.

12. The thermal head according to claim 11, wherein said carbon protective layer has a hardness in a hardest portion which is more than 2000 kg/mm$^2$ in terms of Vickers hardness.

* * * * *